United States Patent [19]

Gray

[11] 4,447,003

[45] May 8, 1984

[54] HINGED LID CONTAINER HAVING FINISHED EDGES

[75] Inventor: Sharon L. Gray, Cranbury, N.J.

[73] Assignee: Alford Industries, Inc., Ridgefield Park, N.J.

[21] Appl. No.: 458,416

[22] Filed: Jan. 17, 1983

[51] Int. Cl.[3] ..... B65D 85/10; A24F 15/12

[52] U.S. Cl. ..... 229/44 CB; 206/268; 206/273; 229/16 A

[58] Field of Search ..... 229/44 CB, 37 R, 38, 229/16 A; 206/268, 273

[56] References Cited

U.S. PATENT DOCUMENTS

| | | | |
|---|---|---|---|
| 2,163,828 | 6/1939 | Chalmers | 229/44 R |
| 2,796,212 | 6/1957 | Graybill | 229/44 CB |
| 2,906,444 | 9/1959 | Weiss | 229/44 CB |
| 3,079,064 | 2/1963 | Ringler | 229/44 CB |
| 3,438,564 | 4/1969 | Moreton | 229/44 CB |

FOREIGN PATENT DOCUMENTS

| | | | |
|---|---|---|---|
| 756442 | 4/1967 | Canada | 229/37 R |
| 1078934 | 3/1960 | Fed. Rep. of Germany | 229/44 CB |

*Primary Examiner*—William Price
*Assistant Examiner*—Gary E. Elkins

[57] ABSTRACT

There is provided a paperboard blank which may be assembled into a hinged lid container or box with a lid portion hinged to a body portion, the body portion comprising front and back panels joined by a base wall, overlapping side panels having extension flaps for forming a finished edge, three essentially triangular gussets, on each side, joined to one another and extending respectively from the free edge of the base wall and from the two adjacent edges of the side walls, the gussets arranged to be folded into packs lying against the inside surface of the body portion, and a lid portion hinged to the back wall comprising panels, flaps and gussets that are duplicative in function to the body portion.

20 Claims, 3 Drawing Figures

HINGED LID CONTAINER HAVING FINISHED EDGES

BACKGROUND OF THE INVENTION (1) Field of the Invention

This invention relates to paper containers such as boxes. More particularly, this invention relates to boxes of the flip top or hinged lid variety made from a single blank of paperboard and having improved finished edges in appearance when folded, glued and completely assembled.

(2) The Prior Art

Hinged lid containers have been widely used for many years as boxes containing crayons or cigarettes. These containers may be constructed from a single sheet of paperboard as shown in U.S. Pat. No. 2,163,828 to Chalmers which describes a basic container blank. The Chalmers container blank, as well as other container blanks, such as Moreton in U.S. Pat. No. 3,438,564 have, when the paperboard blank is in the completely assembled condition, raw edges on side panels and dust flaps.

SUMMARY OF THE INVENTION

According to the present invention there is provided a paperboard blank which may be assembled into a hinged lid container or box with a lid portion hinged to a body portion, the body portion comprising front and back panels joined by a base wall, overlapping side panels having extension flaps for forming a finished edge, three essentially triangular gussets, on each side, joined to one another and extending respectively from the free edge of the base wall and from the two adjacent edges of the side walls, the gussets arranged to be folded into packs lying against the inside surface of the body portion, and a lid portion hinged to the back wall comprising panels, flaps and gussets that are duplicative in function to the body portion.

Thus, it is a general object of this invention to provide an improvement in flip top containers whereby raw or exposed edges of assembled containers are eliminated.

Another object of this invention is to provide a flip top box having increased strength and rigidity when assembled.

Other objects, features and advantages of the present invention will be apparent from the following detailed description of the invention taken in connection with the accompanying drawings.

DETAILED DESCRIPTION OF THE INVENTION

Figure 2:
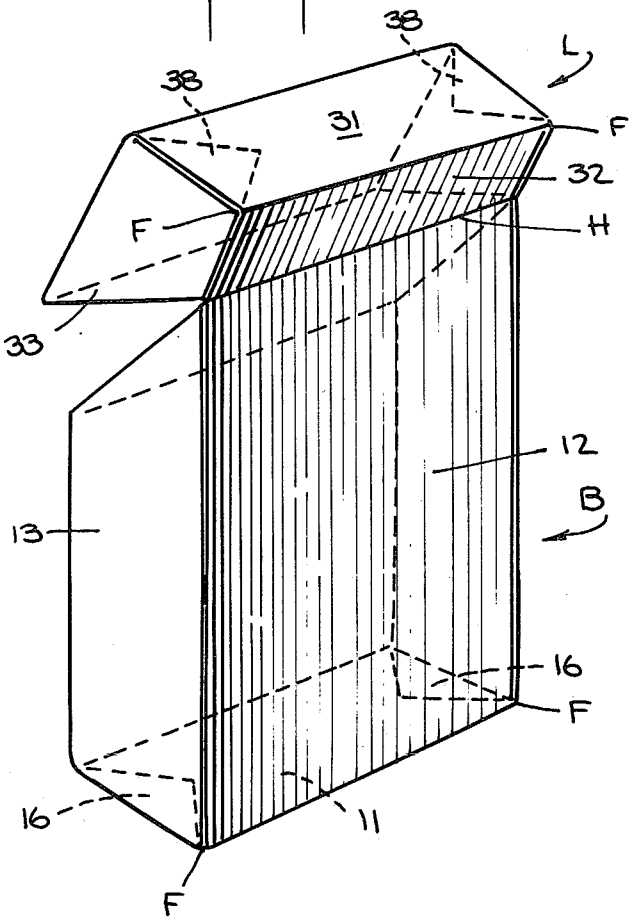
FIG. 2 is a perspective rear view of a partially opened container according to the invention.
Figure 1:
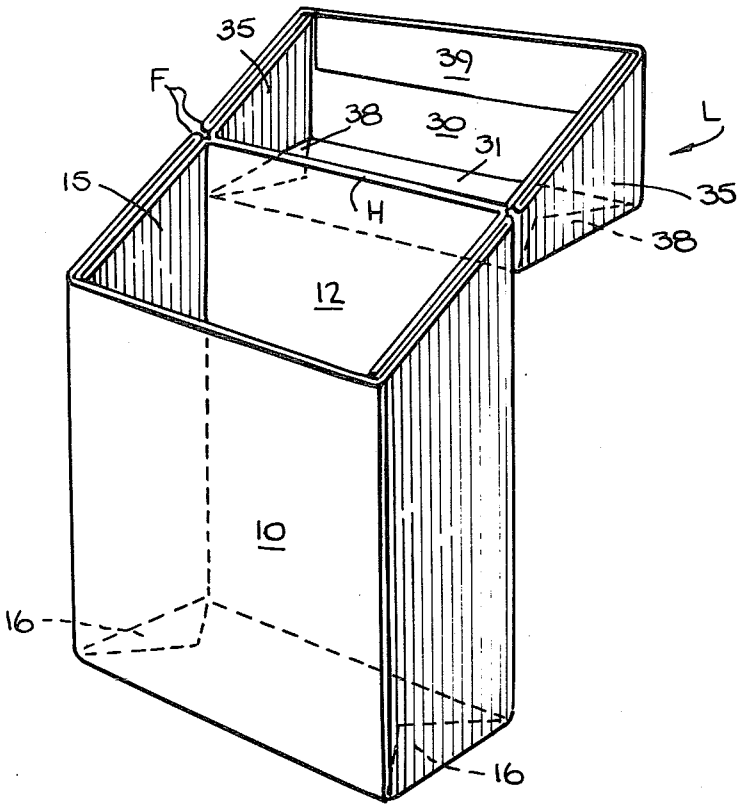
FIG. 1 is a perspective front view of a fully opened container according to the invention.
Figure 3:
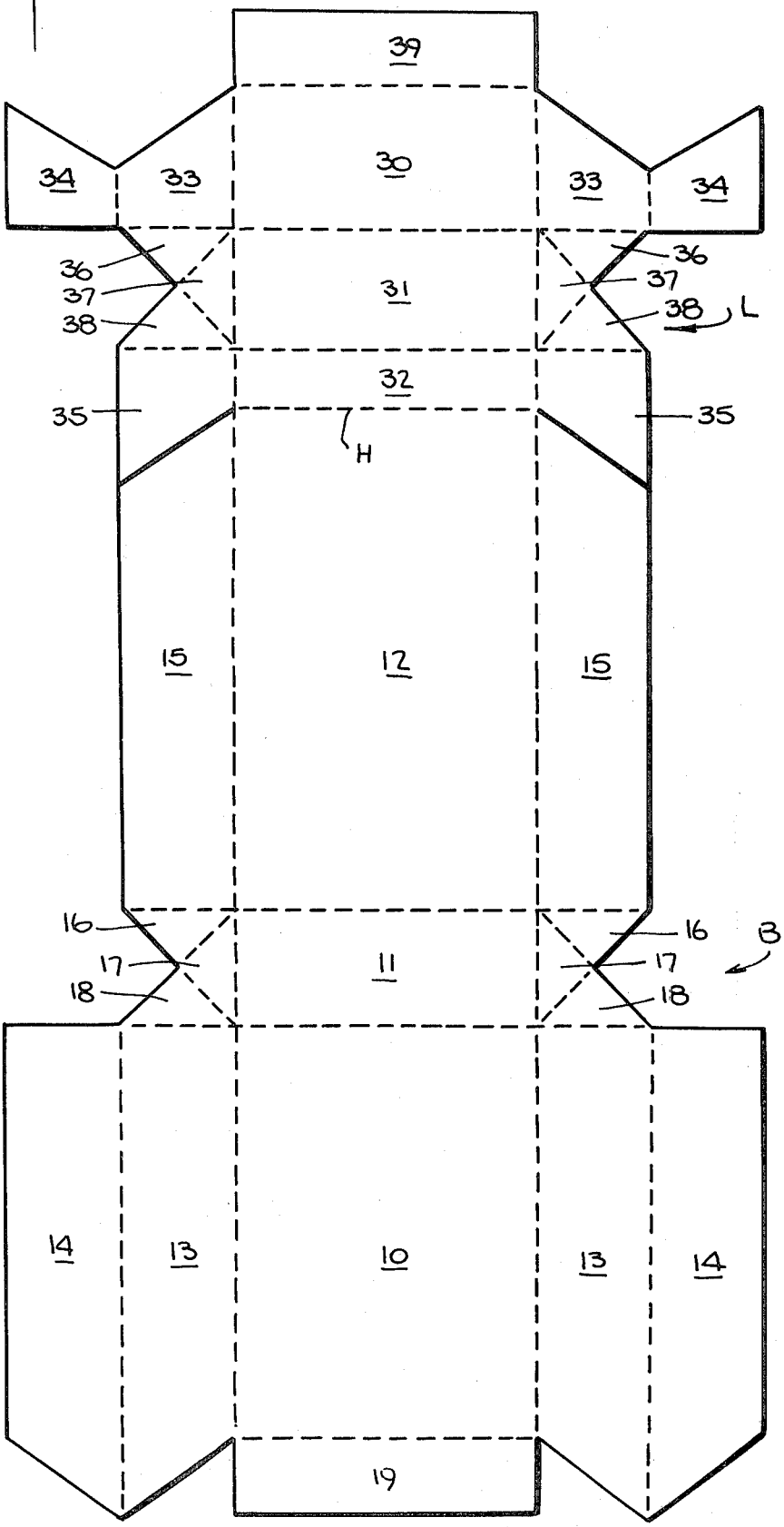
FIG. 3 is a plan view of the blank from which the container is made.

The container shown in FIGS. 1 and 2 is produced from the paper board blank shown in FIG. 3 and comprises a lid L integrally hinged along a line H to a body B. In the blank shown in FIG. 3, the broken lines represent lines along which the blank is creased, embossed or otherwise weakened so as to be folded along these lines. The thickened full lines represent slits.

The blanks are arranged to be folded in a carton having a hinged lid. More specifically, the blank of FIG. 3 is designed to produce the carton as shown in FIGS. 1 and 2.

The body B incorporates a base panel 11 that constitutes the bottom wall of the completed container, and this base panel 11 is interposed between a front panel 10 providing the front of the container body and a back panel 12. Front panel 10 is provided with side panels 13 on opposite sides of front panel 10 and each of the side panels 13 has an extension flap 14. Back panel 12 is provided with side panels 15 on opposite sides of back panel 12. In the completed container extension flap 14 is folded and preferably glued to the inner surface of side panel 13 to form a finished edge (shown as edges F in FIG. 2) and side panels 13 and 15 lap one another with the latter being inside the former.

Each side panel 15 is joined to the adjacent side panel 13 by three triangular gussets 16, 17, 18 joined to one another and having their bases respectively joined to and coextensive with the side panel 15, the base panel 11 and the side panel 13. When the carton is erected, each set of gussets is formed into a triangular pack lying flat against the inside surface of the base panel 11. Thus, the gusset 17 is folded against the base panel 11, and the gusset 18 between the gussets 16, 17 when side panel 13 laps outside the side panel 15 as shown in the figures. If the side panel 15 is to lap outside the side panel 13, the gusset 16 lies between the gussets 17,18. Extending from front panel 10 is front extension panel 19 which, in the completed carton, is folded down against the inside surface of the front panel 10.

The lid L incorporates lid top panel 31 that constitutes the top of the completed container, and this top panel 31 is interposed between lid front panel 30 providing the front of the container lid and a lid back panel 32. Lid back panel 32 is hinged by means of a crease or similar weakened line H to the body back panel 12. At oppostie sides of lid front panel 30 are side panels 33 each provided with an extension flap 34 connected to panel 33 along the side thereof remote from lid front panel 30. At each side of the lid back 32 are lid side panels 35, each of which in the completed container is located face to face with the adjacent lid extension flap 34, the latter being folded against the inner surface of side panel 33. Each lid back side panel 35 is joined to the adjacent lid front side panel 33 by three associated gussets 36, 37, 38 being folded in a pack against the lid top panel 31. These gussets behave similarly to the gussets 16, 17, 18, the gusset 37 folding against the inside surface of the lid top panel 31 and the gusset 36 between the gussets 37, 38. A lid flap 39 is folded against the inner face of the lid front panel 30 so as to give extra strength and avoid a cut or raw edge at the front of the lid.

Adhesive, such as glue or a thermoplastic, may be applied in a variety of ways; for example, between each side body panel 15 and a body extension flap 14, between each lid side panel 35 and a lid extension flap 34. Also, adhesive is applied, between body extension 19 and body front panel 10, as well as between lid flap 39 and lid front 30. It may also be desirable to apply adhesive between body extension flaps 14 and body side panels 13 as well as between lid extension flaps 34 and lid side walls 33.

As can be clearly seen in FIGS. 1 and 2 the assembled container has each edge fully finished on both the body and the lid as noted by finished edges F in each figure. Thus, using the gusset features along with the extension flaps all edges of the container are smooth making for a more aesthetic container and also the container possesses more strength and rigidity when assembled.

While herein has been shown and described the preferred form in which the invention may be embodied, it may be readily understood that various other variations and modifications in the invention may be attained without departing from the spirit and scope of the novel concepts thereof.

What is claimed is:

1. A one-piece container blank for the formation of a hinged lid container, the blank being creased, embossed or otherwise weakened along lines that divide the blank into first areas and second areas which when assembled form a container base defined by said first areas having an integral lid defined by said second areas, said first areas comprising a base panel interposed between a front panel and a back panel, first side panels on opposite sides of the front panel, said first side panels having extension flaps along first edges thereof remote from said front panel, each of said first side panels having a second edge along which said first side panel is connected to said front panel, said second edge being parallel to and laterally spaced from said first edge;

said first areas also comprising second side panels on opposite sides of the back panel arranged to lap and be sealed to the extension flaps of the first side panels and positioned inboard thereof in a completed container constructed by erecting said container blank;

and said second areas comprising a lid back extending from the edge of the back panel remote from the base panel, a lid top extending from the edge of the lid back remote from the back panel, a lid front extending from the edge of the lid top remote from the lid back and lid front side panels having extension flaps along straight edges thereof remote from said lid front, each of said lid front side panels having a another edge along which said lid another side panel is connected to said lid front, said another edge being parallel to and laterally spaced from said straight edge, said lid back being furnished with lid back side panels to be sealed to the inside surfaces of the lid front side extension flaps.

2. A blank according to claim 1 wherein the said lid back side panels are connected to their adjacent second side panels by weakened lines and said lid front includes a flap extension connected to said lid front by weakened lines, the said flap extension being arranged to be folded and secured to the front lid panel in a completed container constructed by erecting said container blank.

3. A blank according to claim 2 including a flap extension connected to the front panel remote from the base panel by weakened lines and arranged to be folded and secured against the inside of the front panel.

4. A hinged lid container in assembled condition formed from the one-piece blank of claim 3 and in which:

said front panel and said lid front are in a first plane, said back panel and said lid back are in a second plane parallel to and laterally spaced from said first plane by a distance equal essentially to the distance between the first and second edges;

third and fourth parallel planes at right angles to said first and second panels and disposed at said opposite sides of said front panel, said third plane containing one of said first side panels and one of said lid front side panels, and said fourth plane containing the other of said first side panels and the other of said lid front side panels;

each of said extension flaps of said first side panels being folded along said first edge to lie flat against one said first side panels and said first edges being adjacent said back panel, said second side panels being sealed against the extension flaps of the first side panels with each of these extension flaps being positioned between one of the first side panels and one of the second side panels and outboard of the latter;

and each of the lid front side panel extension flaps being folded along said straight edge to lie flat against one of said lid front side panels and said straight edges being adjacent said lid back, said lid front side panels being sealed against the extension flaps of the lid front side panels with each of these extension flaps being positioned between one of the lid front side panels and one of the lid back side panels and outboard of the latter.

5. A hinged lid container in assembled condition formed from the one-piece blank of claim 1 and in which:

said front panel and said lid front are in a first plane, said back panel and said lid back are in a second plane parallel to and laterally spaced from said first plane by a distance equal essentially to the distance between the first and second edges;

third and fourth parallel planes at right angles to said first and second planes and disposed at said opposite sides of said front panel, said third plane containing one of said first side panels and one of said lid front side panels, and said fourth plane containing the other of said first side panels and the other of said lid front side panels;

each of said extension flaps of said first side panels being folded along said first edge to lie flat against one said first side panels and said first edges being adjacent said back panel, said second side panels being sealed against the extension flaps of the first side panels with each of these extension flaps being positioned between one of the first side panels and one of the second side panels and outboard of the latter;

and each of the lid front side panel extension flaps being folded along said straight edge to lie flat against one of said lid front side panels and said straight edges being adjacent said lid back, said lid front side panels being sealed against the extension flaps of the lid front side panels with each of these extension flaps being positioned between one of the lid front side panels and one of the lid back side panels and outboard of the latter.

6. A blank according to claim 1 also comprising three essentially triangular gussets at each side of the base panel connecting the edges of the adjacent first and second side panels and the base panel and foldable into a pack lying flat against the inside surface of the base panel; and three essentially triangular gussets at each side of the lid top connecting the adjacent edges of the front lid side, the lid back side and the lid top and foldable into a pack lying flat against the inside surface of the lid top.

7. A hinged lid container in assembled condition formed from the one-piece blank of claim 6 and in which:

said front panel and said lid front are in a first plane, said back panel and said lid back are in a second plane parallel to and laterally spaced from said first plane by a distance equal essentially to the distance between the first and second edges;

third and fourth parallel planes at right angles to said first and second planes and disposed at said opposite sides of said front panel, said third plane containing one of said first side panels and one of said lid front side panels, and said fourth plane containing the other of said first side panels and the other of said lid front side panels;

each of said extension flaps of said first side panels being folded along said first edge to lie flat against one said first side panels and said first edges being adjacent said back panel, said second side panels being sealed against the extension flaps of the first side panels with each of these extension flaps being positioned between one of the first side panels and one of the second side panels and outboard of the latter;

and each of the lid front side panel extension flaps being folded along said straight edge to lie flat against one of said lid front side panels and said straight edges being adjacent said lid back, said lid front side panels being sealed against the extension flaps of the lid front side panels with each of these extension flaps being positioned between one of the lid front side panels and one of the lid back side panels and outboard of the latter.

8. A blank according to claim 1 in which the first side panels and extension flaps thereof are elongated and are essentially of the same width, the width of said first side panel being the distance between said first and second edges thereof.

9. A hinged lid container in assembled condition formed from the one-piece blank of claim 8 and in which:

said front panel and said lid front are in a first plane, said back panel and said lid back are in a second plane parallel to and laterally spaced from said first plane by a distance equal essentially to the distance between the first and second edges;

third and fourth parallel planes at right angles to said first and second planes and disposed at said opposite sides of said front panel, said third plane containing one of said first side panels and one of said lid front side panels, and said fourth plane containing the other of said first side panels and the other of said lid front side panels;

each of said extension flaps of said first side panels being folded along said first edge to lie flat against one said first side panels and said first edges being adjacent said back panel, said second side panels being sealed against the extension flaps of the first side panels with each of these extension flaps being positioned between one of the first side panels and one of the second side panels and outboard of the latter;

and each of the lid front side panel extension flaps being folded along said straight edge to lie flat against one of said lid front side panels and said straight edges being adjacent said lid back, said lid front side panels being sealed against the extension flaps of the lid front side panels with each of these extension flaps being positioned between one of the lid front side panels and one of the lid back side panels and outboard of the latter.

10. A blank according to claim 8 in which the first and second side panels are essentially of the same size and shape.

11. A hinged lid container in assembled condition formed from the one-piece blank of claim 10 and in which:

said front panel and said lid front are in a first plane, said back panel and said lid back are in a second plane parallel to and laterally spaced from said first plane by a distance equal essentially to the distance between the first and second edges;

third and fourth parallel planes at right angles to said first and second planes and disposed at said opposite sides of said front panel, said third plane containing one of said first side panels and one of said lid front side panels, and said fourth plane containing the other of said first side panels and the other of said lid front side panels;

each of said extension flaps of said first side panels being folded along said first edge to lie flat against one said first side panels and said first edges being adjacent said back panel, said second side panels being sealed against the extension flaps of the first side panels with each of these extension flaps being positioned between one of the first side panels and one of the second side panels and outboard of the latter;

and each of the lid front side panel extension flaps being folded along said straight edge to lie flat against one of said front side panels and said straight edges being adjacent said lid back, said lid front side panels being sealed against the extension flaps of the lid front side panels with each of these extension flaps being positioned between one of the lid front side panels and one of the lid back side panels and outboard of the latter.

12. A blank according to claim 10 in which the first side panels and extension flaps thereof are essentially of the same size and shape.

13. A hinged lid container in assembled condition formed from the one-piece blank of claim 12 and in which:

said front panel and said lid front are in a first plane, said back panel and said lid back are in a second plane parallel to and laterally spaced from said first plane by a distance equal essentially to the distance between the first and second edges;

third and fourth parallel planes at right angles to said first and second planes and disposed at said opposite sides of said front panel, said third plane containing one of said first side panels and one of said lid front side panels, and said fourth plane containing the other of said first side panels and the other of said lid front side panels;

each of said extension flaps of said first side panels being folded along said first edge to lie flat against one said first side panels and said first edges being adjacent said back panel, said second side panels being sealed against the extension flaps of the first side panels with each of these extension flaps being positioned between one of the first side panels and one of the second side panels and outboard of the latter;

and each of the lid front side panel extension flaps being folded along said straight edge to lie flat against one of said lid front side panels and said straight edges being adjacent said lid back, said lid front side panels being sealed against the extension flaps of the lid front side panels with each of these extension flaps being positioned between one of the lid front side panels and one of the lid back side panels and outboard of the latter.

14. A blank according to claim 12 in which the lid front side panels and extension flaps thereof are essentially the same size and shape.

15. A hinged lid container in assembled condition formed from the one-piece blank of claim 14 and in which:

said front panel and said lid front are in a first plane, said back panel and said lid back are in a second plane parallel to and laterally spaced from said first plane by a distance equal essentially to the distance between the first and second edges;

third and fourth parallel planes at right angles to said first and second planes and disposed at said opposite sides of said front panel, said third plane containing one of said first side panels and one of said lid front side panels, and said fourth plane containing the other of said first side panels and the other of said lid front side panels;

each of said extension flaps of said first side panels being folded along said first edge to lie flat against one said first side panels and said first edges being adjacent said back panel, said second side panels being sealed against the extension flaps of the first side panels with each of these extension flaps being positioned between one of the first side panels and one of the second side panels and outboard of the latter;

and each of the lid front side panel extension flaps being folded along said straight edge to lie flat against one of said lid front side panels and said straight edges being adjacent said lid back, said lid front side panels being sealed against the extension flaps of the lid front side panels with each of these extension flaps being positioned between one of the lid front side panels and one of the lid back side panels and outboard of the latter.

16. A blank according to claim 14 also comprising three essentially triangular gussets at each side of the base panel connecting the edges of the adjacent first and second side panels and the base panel and foldable into a pack lying flat against the inside surface of the base panel; and three essentially triangular gussets at each side of the lid top connecting the adjacent edges of the front lid side, the lid back side and the lid top and foldable into a pack lying flat against the inside surface of the lid top.

17. A hinged lid container in assembled condition formed from the one-piece blank of claim 16 and in which:

said front panel and said lid front are in a first plane, said back panel and said lid back are in a second plane parallel to and laterally spaced from said first plane by a distance equal essentially to the distance between the first and second edges;

third and fourth parallel planes at right angles to said first and second planes and disposed at said opposite sides of said front panel, said third plane containing one of said first side panels and one of said lid front side panels, and said fourth plane containing the other of said first side panels and the other of said lid front side panels;

each of said extension flaps of said first side panels being folded along said first edge to lie flat against one said first side panels and said first edges being adjacent said back panel, said second side panels being sealed against the extension flaps of the first side panels with each of these extension flaps being positioned between one of the first side panels and one of the second side panels and outboard of the latter;

and each of the lid front side panel extension flaps being folded along said straight edge to lie flat against one of said lid front side panels and said straight edges being adjacent said lid back, said lid front side panels being sealed against the extension flaps of the lid front side panels with each of these extension flaps being positioned between one of the lid front side panels and one of the lid back side panels and outboard of the latter.

18. A blank according to claim 16 wherein the said lid back side panels are connected to their adjacent second side panels by weakened lines and said lid front includes a flap extension connected to said lid front by weakened lines, the said flap extension being arranged to be folded and secured to the front lid panel in a completed container construced by erecting said container blank; and a flap extension connected to the front panel remote from the base panel by weakened lines and arranged to be folded and secured against the inside of the panel front.

19. A hinged lid container in assembled condition formed from the one-piece blank of claim 18 and in which:

said front panel and said lid front are in a first plane, said back panel and said lid back are in a second plane parallel to and laterally spaced from said first plane by a distance equal essentially to the distance between the first and second edges;

third and fourth parallel planes at right angles to said first and second planes and disposed at said opposite sides of said front panel, said third plane containing one of said first side panels and one of said lid front side panels, and said fourth plane containing the other of said first side panels and the other of said lid front side panels;

each of said extension flaps of said first side panels being folded along said first edge to lie flat against one said first side panels and said first edges being adjacent said back panel, said second side panels being sealed against the extension flaps of the first side panels with each of these extension flaps being positioned between one of the first side panels and one of the second side panels and outboard of the latter;

and each of the lid front side panel extension flaps being folded along said straight edge to lie flat against one of said lid front side panels and said straight edges being adjacent said lid back, said lid front side panels being sealed against the extension flaps of the lid front side panels with each of these extension flaps being positioned between one of the lid front side panels and one of the lid back side panels and outboard of the latter.

20. A blank according to claim 8 wherein the base panel is a rectangle having opposed relatively long edges connected at opposite ends by relatively short edges; said front and back panels respectively being adjacent said base panel and connected thereto along opposite ones of said relatively long edges.

* * * * *

UNITED STATES PATENT AND TRADEMARK OFFICE

CERTIFICATE OF CORRECTION

PATENT NO. : 4,447,003

DATED : May 8, 1984

INVENTOR(S) : Sharon L. Gray

It is certified that error appears in the above-identified patent and that said Letters Patent is hereby corrected as shown below:

IN THE CLAIMS

Col. 3, line 19, - delete "base" and substitute therefor --body--

Col. 3, line 44 - delete "a"; delete "another" second occurrence and substitute therefor --front--

Col. 3, line 51 - delete "connected to" and substitute therefor --separated from--

Col. 3, line 52 - delete "weakened" and substitute therefor --slit--

Col. 3, line 53 - after "by" insert --a--

Col. 3, line 54 - delete "lines" and substitute therefor --line--

Col. 4, line 2 - delete "panels" and substitute therefor --planes--

Signed and Sealed this

*Twenty-second* Day of *April 1986*

[SEAL]

*Attest:*

DONALD J. QUIGG

*Attesting Officer*

*Commissioner of Patents and Trademarks*